United States Patent [19]

Chantry

[11] Patent Number: 4,938,698

[45] Date of Patent: Jul. 3, 1990

[54] TRAINING AID FOR SNOWBOARD MANEUVERING

[76] Inventor: Michael Chantry, P.O. Box 1302, Tahoe City, Calif. 95730

[21] Appl. No.: 338,618

[22] Filed: Apr. 17, 1989

[51] Int. Cl.[5] ..... A63B 69/18

[52] U.S. Cl. ..... 434/253; 446/327

[58] Field of Search ..... 434/253; 280/14.2; 446/327, 330

[56] References Cited

U.S. PATENT DOCUMENTS

| | | | |
|---|---|---|---|
| 3,574,969 | 3/1969 | Cleveland | 46/101 |
| 4,108,452 | 8/1978 | Baron | 280/11.3 |
| 4,305,603 | 12/1981 | Müller et al. | 280/14.2 |
| 4,403,785 | 9/1983 | Hottel | 280/14.2 |

*Primary Examiner*—Richard J. Apley
*Assistant Examiner*—Rachel M. Healey
*Attorney, Agent, or Firm*—Roger A. Marrs

[57] ABSTRACT

A device for use in aiding a snowboard trainee in practicing a variety of snowboard maneuvers is disclosed herein having an elongated platform conformal to and simulating a miniature snowboard, including a slightly up-curved tail and a more pronounced upwardly curved nose. The plateform nose and tail are integrally joined by a flat midportion carrying a pair of attachment pads on its upper surface adapted to be detachably connected with a pair of finger couplers carried on the fingertips of the user. Attachment devices releasably connect the finger couplers with the attachment pads.

1 Claim, 1 Drawing Sheet

FIG. 1.
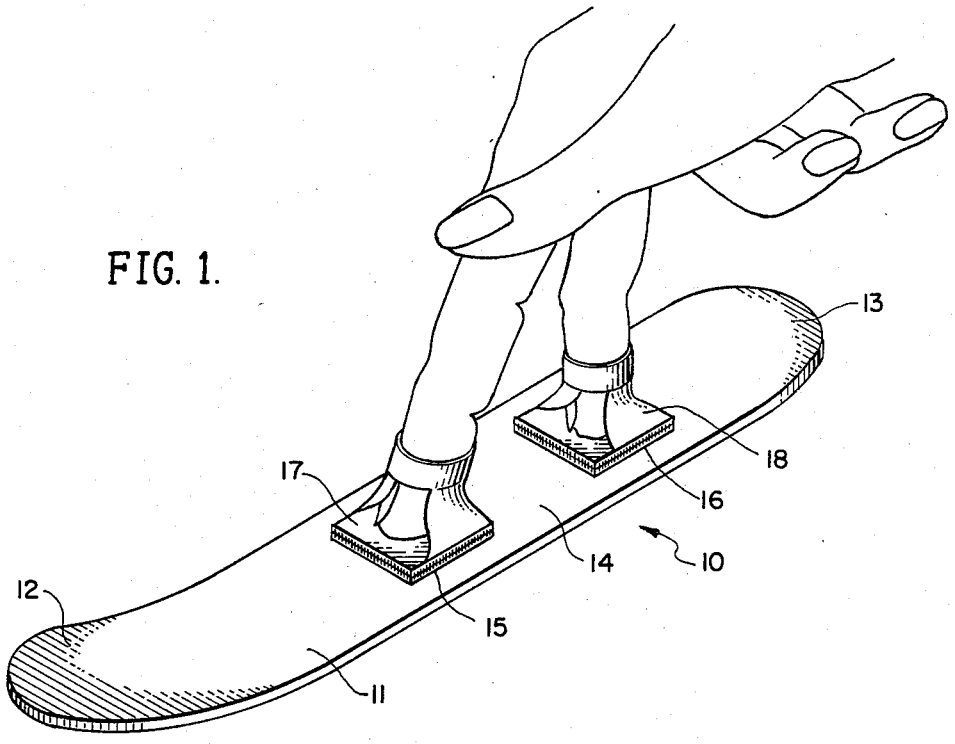
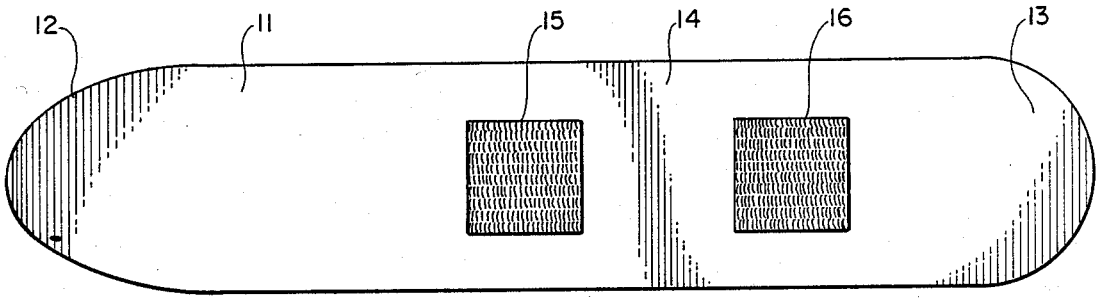
FIG. 2.
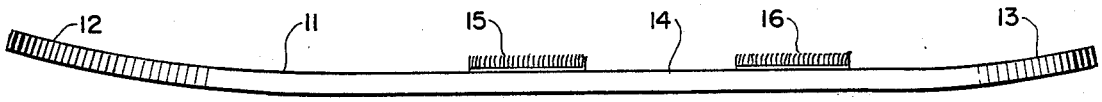
FIG. 3.
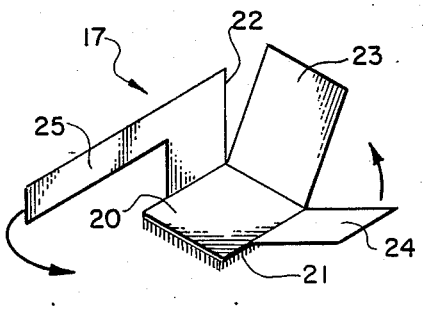
FIG. 4.
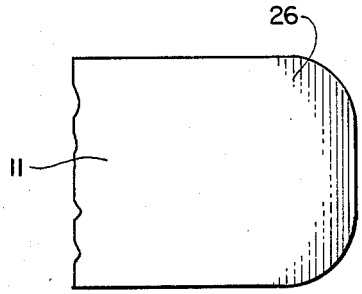
FIG. 5.

TRAINING AID FOR SNOWBOARD MANEUVERING

BACKGROUND OF THE INVENTION

1. Field of the Invention

The present invention relates to the field of sports training aids, and more particularly to a novel training aid for assisting snowboard users in practicing a variety of snowboard maneuvering by utilizing finger maneuvering employing a miniaturized snowboard.

2. Brief Description of the Prior Art

While engaging in the sport of snowboarding, the user stands or balances himself on a ski-like platform while traveling down a snow slope. During travel, an experienced snowboarder has the option of performing a variety of maneuvers which add to the enjoyment of the sport and which provide a visual display of talent. In order to perform such maneuvers, the participant must engage in extensive practice so that the intricate body positioning can be learned. In many instances, the participant is injured or has difficulty in learning the maneuvering so that the sport is limited to a relatively few rugged individuals.

Therefore, a long-standing need has existed to provide a training aid for snowboard participants or users which will assist in teaching the participant or user to perform intricate maneuvers without actually having to engage in the full activity Preferably, the device should be of a miniature snowboard type and readily maneuverable by the hand of the user so that visual observations can be made of motions and body orientations during simplified practice sessions. In one form, it is preferred to have an elongated miniature snowboard which may be readily attached to the hand or fingers of the user so that the user's arm can be used to deploy the miniature snowboard through a variety of maneuvers.

SUMMARY OF THE INVENTION

Accordingly, the above problems and difficulties are obviated by the present invention which provides an elongated platform having an upwardly curved tail with an upwardly curved nose end separated by a flat midsection or portion. Means are provided for detachably connecting the fingers of the participant or user to the upper surface of the platform midsection whereby the fingers or hand of the user may be manipulated to simulate a variety of snowboard maneuvers. In one form of the invention, the attachment means may be a pair of couplers carried on the fingertips of one hand, which are registered and attached to a pair of attachment pads on the upper surface of the platform midsection. Each finger coupler of the pair may include a socket portion into which the user's finger is inserted and may further include an attachment or coupler means compatible for releasable attachment to the attachment pads on the platform.

Therefore, it is among the primary objects of the present invention to provide a novel training aid for snowboard users or participants which may be used for simulating a variety of snowboard maneuvers without the participant's engaging in an actual snowboard activity.

Another object of the present invention is to provide a training method and device for use by snowboard participants that may be readily carried on the fingers or hand of the user by which a variety of maneuvers may be simulated through the deployment of the device at the selection of the user so that a variety of snowboard maneuvers are thusly simulated.

Still a further object of the present invention is to provide a novel training aid for practicing snowboard maneuvers whereby the participant or user may readily gain visual and physical relationships relative to snowboard maneuvering.

Still another object of the present invention is to provide a means for communicating snowboard maneuvering to fellow snowboarders which takes advantage of visual and physical relationships to exemplify the maneuvers.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the miniature snowboard of the present invention detachably connected to the fingers of the user;

FIG. 2 is a top plan view of the miniature simulated snowboard shown in FIG. 1;

FIG. 3 is a side elevational view of the miniature snowboard;

FIG. 4 is a fragmentary top plan view showing another embodiment of miniature snowboard; and FIG. 5 is a front perspective view showing a typical finger coupler employed in the inventive concept shown in FIG. 1.

DESCRIPTION OF THE PREFERRED EMBODIMENT

Referring to FIG. 1, the novel training aid of the present invention is illustrated in the general direction of arrow 10 which includes an elongated platform 11 having an upwardly curved or turned nose forward end 12 and a slightly upwardly curved tailpiece 13. The forward end and the tailpiece are joined together by a flat midsection 14 in an integral manner. The platform 11 is intended to simulate an actual snowboard and is, in fact, a reduced or miniaturized version of an actual snowboard The midsection 14 includes an upper surface which is employed for carrying a pair of spaced-apart attachment pads, indicated by numerals 15 and 16 respectively to which a pair of finger couplers 17 and 18 are releasably connected. Each of the respective finger couplers includes a socket portion into which the tips of the user's fingers are disposed so that the platform 11 may be carried on the fingers for manual manipulation by the user.

In one form of the invention, the attachment pads and the finger couplers include hook and pile fastening means to effect the detachable connection. As shown more clearly in FIG. 2, the pad 15 and the pad 16 may be squares of pile material fixedly carried on the surface of the platform midsection 14 while the hook portion of the hook and pile fastener is carried on the underside of the finger couplers 17 and 18. Once the finger couplers are attached to the user's fingers, the hook and pile fastening portions are aligned or placed in registry so that contact is made. An important feature of the invention resides in the fact that the person using the training aid may be either right or left-handed and the arrangement of the finger couplers and attachment pads will receive the fingers of either hand.

FIGS. 2 and 3 illustrate that the attachment pads 15 and 16 are arranged in fixed spaced-apart relationship with respect to each other on the upper surface of the platform 11. Also, it is to be understood that although a hook and pile fastener means is illustrated, other adhesive attachment means may be provided which include a variety of bonding agents or the like.

Referring now in detail to FIG. 4, a finger coupler is illustrated in the general direction of arrow 17 which includes a face 20 carrying the attachment means such as a plurality of hooks 21 on its external bottom side. A socket is formed for receiving the fingertip of the user by folding sidewalls 22, 23 and 24 upwardly to define a cavity for insertably receiving the fingertip. Once the socket or cavity has been formed, an attachment band 25 is trained about the upper walls of the sides 22, 23 and 24 and by means of adhesive carried on the band 25, the walls are maintained together about the fingertip of the user. Thus established, the attachment hooks 21 are exposed as being extended from the ends of the user's fingers for ready indexing or registering with the pads 15 and 16 respectively.

Referring to FIG. 5, another embodiment of snowboard miniaturization is illustrated in which the tailpiece 13 is indicated by numeral 26 and considered to be flat as compared with the tailpiece 13 which is considered round. Therefore, it can be seen that the attachment means of the present invention can be used with a variety of differently shaped simulations of snowboards.

In view of the foregoing, it can be seen that the user's fingers, such as the index and first finger, can be insertably received into the sockets of the pair of finger couplers 17 and 18. The band 25 associated with each of the couplers can be wrapped about the sides 22, 23 and 24 to secure the couplers to each of the fingertips of the user. Then, the user can index the respective finger couplers with the respective attachment pads 15 and 16 for releasable securement thereto. Once assembled, the user may now employ the invention as a means for communicating and visually showing how a snowboard maneuver or a ski maneuver is performed using manipulation of fingers and hand. Instructors can demonstrate a maneuver and communicate the technique to the pupils by using the present invention and the maneuvers can be practiced anywhere and anytime which creates interest in improving performance.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a training aid and demonstrating device for use with the fingers of the user in the training of a variety of simulated body maneuvering in a selected sport, the combination comprising:

an elongated platform of no more than five inches in length and having a flat central midsection integrally joining upwardly curved forward and tail portions simulating a snowboard or ski;

coupling means releasably joining said platform midsection with the fingers of the user for manually deploying said elongated platform through the variety of simulated body maneuvers;

said elongated platform is composed of non-load bearing, lightweight material and is a reduced scale replica of said snowboard or ski;

said coupling means includes attachment means carried on said elongated platform midsection;

at least one coupler having a socket for insertably receiving a finer of the user and adapted to releasably engage with said attachment means;

said attachment means includes a pair of attachment pads arranged in fixed spaced-apart relationship;

said coupler means includes a pair of separate and independent couplers carried on the fingertips of two fingers of the user adapted to be manually registered in alignment with said pair of attachment pads preparatory to engagement;

said pair of couplers and said attachment pads include a hook and pile closure;

each of said couplers includes a securement means engageable with said attachment pads respectively and said securement means being downwardly depending from a sidewall defining an open socket for receiving the fingertips of the user; and a closure band integral with said sidewall for encircling each of said coupler sidewalls and user fingers for securement onto the fingertips of the user.

* * * * *